US006328232B1

(12) United States Patent
Haltiner, Jr. et al.

(10) Patent No.: US 6,328,232 B1
(45) Date of Patent: Dec. 11, 2001

(54) FUEL INJECTOR SPRING FORCE CALIBRATION TUBE WITH INTERNALLY MOUNTED FUEL INLET FILTER

(75) Inventors: Karl Jacob Haltiner, Jr., Fairport; Robert B. Perry, Leicester; Peter Ronald Wendt, Fairport; Jay Keith Sofianek, Webster, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/487,649

(22) Filed: Jan. 19, 2000

(51) Int. Cl.[7] ..... B05B 1/30

(52) U.S. Cl. ..... 239/585.1; 239/533.2; 239/533.9; 239/584; 239/575; 239/585.3; 239/DIG. 23

(58) Field of Search ..... 239/575, 533.2, 239/533.3, 533.4, 533.6, 533.7, 533.9, 533.11, 533.12, 585.1, 585.2, 585.3, 585.4, 585.5, DIG. 23, 584; 251/129.21

(56) References Cited

U.S. PATENT DOCUMENTS 4,218,021 * 8/1980 Palma ..... 239/585.1
5,494,224 * 2/1996 Hall et al. ..... 239/585.5
5,755,386 * 5/1998 Lavan et al. ..... 239/585.4
5,921,475 * 7/1999 DeVriese et al. ..... 239/585.4
5,937,887 * 8/1999 Baxter et al. ..... 239/585.3 X
5,979,866 * 11/1999 Baxter et al. ..... 239/585.1
6,019,128 * 2/2000 Reiter ..... 239/585.1

* cited by examiner

*Primary Examiner*—David A. Scherbel
*Assistant Examiner*—Robin O. Evans
(74) *Attorney, Agent, or Firm*—John A. VanOphem

(57) ABSTRACT

An engine fuel injector (10) having a fuel inlet tube (12) and a biasing spring (56) loading a solenoid actuated injection valve (50) within the injector (10) is provided with a calibration assembly (58) combining the calibration member (74) or tube with an internally mounted fuel inlet filter (76). The calibration member (74) may include a body (78) with an enlarged end (88) that is interference fitted within the fuel inlet tube (12) and an opposite stepped in end (80) forming a seat (82) which is engaged by the biasing spring (56). The fuel filter (76) has an enlarged annular base (92) fixed within the enlarged end (88) of the calibration member (74) and having an associated filter screen (98) or element through which fuel passing through the calibration member is filtered for passage through the injector (10). The filter screen (98) may extend completely within the calibration member (74), or alternatively, can project outward from the enlarged end (86) of the calibration member (74) into the inlet end (86) of the fuel inlet tube (12). Advantages in the ease of calibration, reduced assembly costs and improved filtration of fuel are provided.

20 Claims, 3 Drawing Sheets

FUEL INJECTOR SPRING FORCE CALIBRATION TUBE WITH INTERNALLY MOUNTED FUEL INLET FILTER

TECHNICAL FIELD

This invention relates to engine fuel injectors, particularly of the solenoid actuated top feed type, and more particularly to an injector having an inlet fuel filter mounted within a frictionally retained valve spring calibration tube.

BACKGROUND OF THE INVENTION

It is known in the art to provide an engine top feed fuel injector with a fuel inlet filter mounted within the fuel inlet tube. It is further known to provide a calibration tube which is slidable within the inlet tube for adjusting the force on a solenoid actuated fuel inlet valve and to propose a fuel filter mounted on the outer end of the calibration tube.

In this proposal, the calibration tube is adjusted by a tool which engages the closed outer end of the filter and forces it down with the tube until the desired valve spring force is achieved. The calibration tube is then fixed to the inlet tube by any suitable means to hold the calibration tube in place. The friction force of the tube by itself is inadequate to maintain the set calibration tube position since adjustment of the tube by applying a force to the filter body requires that the sliding force of the calibration tube be limited to an amount which the plastic body of the filter is able to withstand, preferably not more than about two pounds. Also, the low force sliding fit of the calibration tube in the fuel inlet tube allows fuel carrying contaminant particles up to 100 microns in diameter to bypass the filter by passing through clearance spaces between the tubes. It is accordingly desired to provide a calibration tube mounted inlet filter which overcomes the problems of the prior art.

SUMMARY OF THE INVENTION

The present invention provides a fuel injector having a fuel tube at the inlet end and an injection valve at the discharge end of the injector, the valve including a valve element reciprocable against and away from a valve seat. A biasing spring operatively engages the valve element, optionally through a solenoid-actuated armature, and a calibration member or tube is adjustable within the injector to establish a set force of the valve biasing spring.

A fuel filter is mounted within the calibration member, preferably in a manner to allow direct engagement of a calibration tool with the outer end of the calibration member for adjusting the spring force. The fuel filter is preferably mounted in the calibration tube with an interference fit that is adequate to maintain the set position by friction between the members without requiring an additional securing step. Optionally, the calibrating tool may engage a base or mounting portion of the filter body snap fitted or otherwise mounted in a calibration tube. In any case, a force adequate to provide the desired interference fit may be applied to the calibration tube without passing through the complete filter body. Preferably, the interference fit is also sufficient to prevent the bypassing of fuel past the calibration tube and around the filter so as to prevent particles larger than the filter is designed to remove from remaining in the fuel stream. Thus, the filter and the interference fit may be selected to capture particles greater than about 30 microns in diameter.

These and other features and advantages of the invention will be more fully understood from the following description of certain specific embodiments of the invention taken together with the accompanying drawings.

DESCRIPTION OF THE PREFERRED EMBODIMENT

Figure 1:
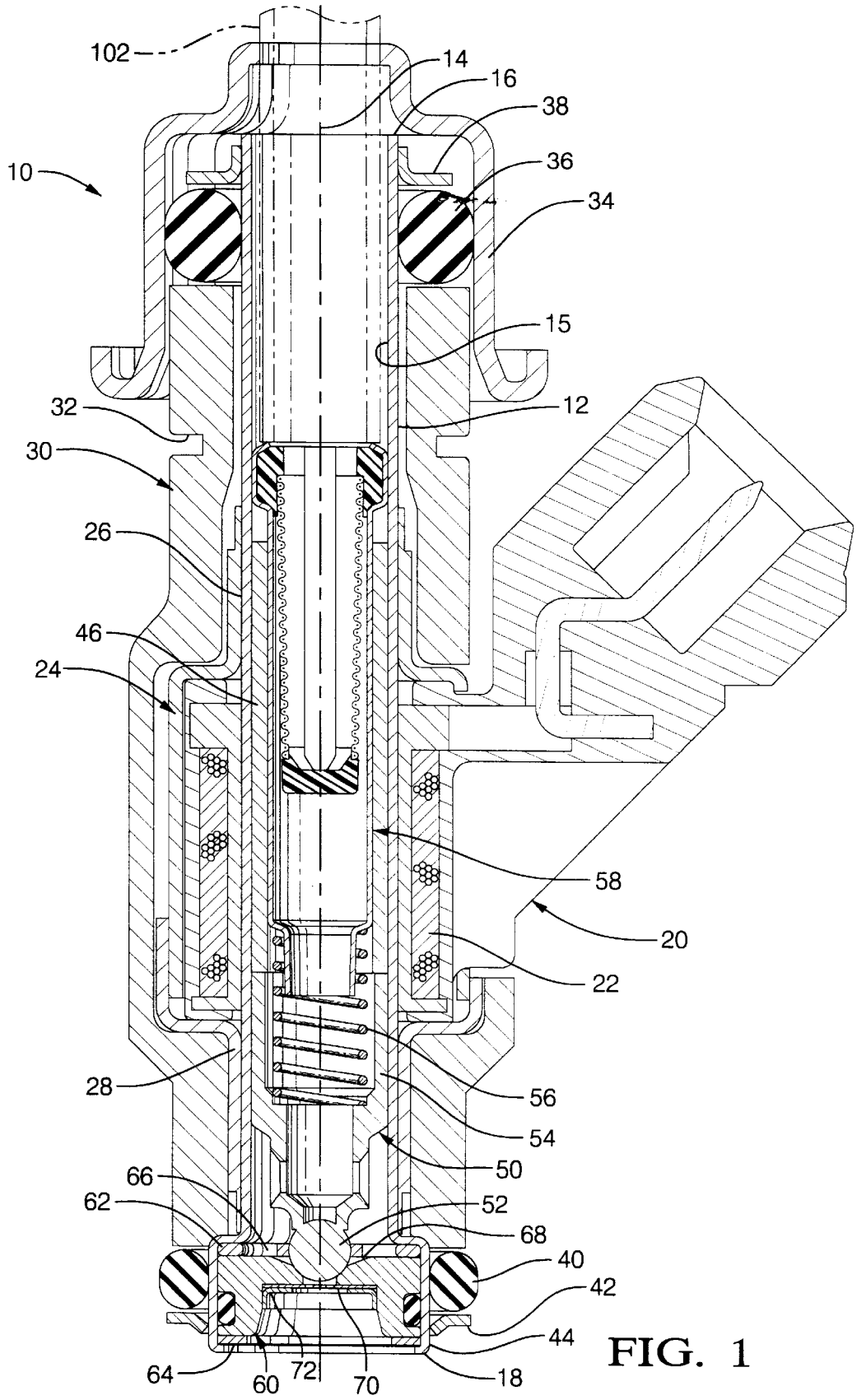
FIG. 1 is a cross-sectional view through an engine fuel injector of the top feed type shown as mounted within an engine cylinder head and connected within the cup of an engine fuel supply system.

Referring first to FIG. 1 of the drawings in detail, numeral 10 generally indicates a solenoid actuated fuel injector which is similar to that disclosed in copending U.S. patent application Ser. No. 09/320,501, filed May 26, 1999, but includes modifications in accordance with the present invention.

Injector 10 includes a continuous fuel tube 12 which is centered on a central axis 14 and encloses a continuous fuel passage 15 through the injector from an inlet end 16 of the tube to a discharge end 18. Preferably, the fuel tube 12 has no openings except at the inlet and outlet ends and defines a continuous imperforate passage in which fuel is conducted and kept separate from all the components of the injector that are mounted externally of the fuel tube. These include a coil assembly 20 having a solenoid coil 22 extending around and closely adjacent to the fuel tube 12. A magnetic coil body or strap 24 surrounds the coil 22 and has upper and lower portions 26, 28 fixed to the outer surface of the tube 12.

A support member or cover 30 is formed as a two-piece tubular member that is assembled over the tube and surrounds the body 24. The cover includes a slot 32 for receiving a retainer clip, not shown, that holds the injector inlet end within a cup 34 of an associated fuel rail, not shown. The cover also provides a backup surface for constraining a seal ring 36 of a conventional O-ring type. A push-on seal retainer 38 is frictionally or otherwise retained on the inlet end 16 of the fuel tube 12 to form with the other parts an annular groove in which the seal ring 36 is retained. A lower end of the cover 30 also backs up an O-ring seal 40 retained by a lower seal retainer 42 on an expanded diameter portion 44 at the lower end of the fuel tube 12.

Within the fuel tube 12, a tubular magnetic pole 46 is fixed in engagement with the interior surface of the fuel tube 12. The pole 46 extends from adjacent the upper end 26 of the magnetic body 24 to a position within the axial extent of the coil 22. An injection valve 50 is reciprocable within the tube 12 and includes a ball end 52 connected with a hollow armature 54 that slides within the tube 12. A biasing spring 56 engages an upper end of the armature 54 and is compressed with a predetermined force by a calibration assembly 58 best shown in FIG. 2 and to be subsequently further described.

Within the expanded portion 44 of the fuel tube 12, a valve seat 60 and a lower guide 62 are retained by crimped over portions of the tube outlet end 18 which engage a seat washer 64. The lower guide 62 is a disc which guides the ball end 52 of the injection valve and includes openings 66 that allow fuel flow through the guide to a conical surface 68 of the valve seat against which the ball end 52 seats in the valve closed position. A central discharge opening of the valve seat 60 connects with a multi-hole spray director 70 held in a recess of the valve seat by a retainer 72.

To properly control the speed and efficiency of valve action in the injector, it is important that the valve stroke be set a desired predetermined value. This may be accomplished by providing for adjusting the position of the valve seat. However, in the present embodiment, the valve stroke is preferably set by making the magnetic pole 46 axially adjustable within the fuel tube 12 to establish the desired clearance between the pole 46 and the valve armature 54 in the valve closed position. This is done by sliding the pole inside the tube to obtain the proper clearance, after which the pole may be fixed within the tube by the friction developed from an interference fit or by crimping or otherwise securing the tube to the pole in the adjusted position.

Figure 2:
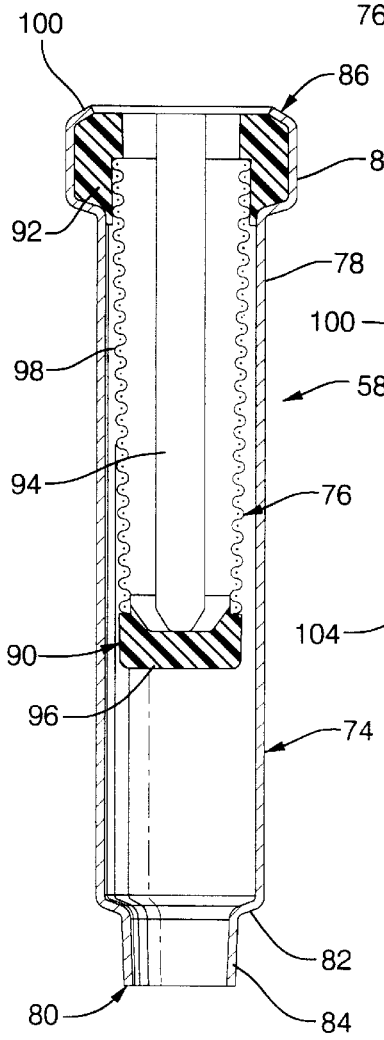
FIG. 2 is a cross-sectional view of a preferred embodiment of valve spring calibration tube having an internally mounted fuel filter according to the invention, as shown in FIG. 1.

In accordance with the invention, the calibration assembly 58 shown in FIGS. 1 and 2 is substantially modified from the generally straight calibration tube disclosed in the previously mentioned U.S. patent application Ser. No. 09/320,501 and which is known in injectors of this type. In the present invention, the calibration tube and separately mounted filter of the previously mentioned U.S. patent application Ser. No. 09/320,501 are replaced by the calibration assembly 58 which includes a preferably metal calibration tube or member 74 in which a fuel intake filter 76 is mounted. The calibration member 74 includes a generally tubular body 78 sized to be telescopically received within the magnetic pole 46 of the injector. At its lower end 80, body 78 is stepped into a smaller diameter forming an annular seat 82 against which the biasing valve spring 56 is seated and an annular extending spring guide 84 which extends into spring 56 for guiding the upper end thereof.

At its upper end 86, the calibration member body 78 has a diametrically enlarged or expanded portion 88 which is sized to be an interference fit within the injector fuel tube 12 where it is received toward the inlet end of the injector. Fuel filter 76 includes a plastic frame 90 having an enlarged annular base 92 connected by two or more longitudinal ribs 94 with a solid cap 96, forming a plurality of spaced windows through which fuel may pass. A tubular filter screen 98 is molded into the plastic frame 90 and extends between the base 92 and cap 96 alongside the ribs 94. The screen 98 covers all the windows and requires fuel passing therethrough to pass through the filter screen to screen out solid particles of a desired size. In the present instance, particles carried in the fuel that are greater than 30 microns are separated out by the filter screen 98.

In this preferred embodiment, the filter 76 has its base 92 fitted tightly within the enlarged portion 88 of the calibration member body 78, the upper end 86 of which is crimped or rolled over at 100 to mount the filter tightly within the calibration member 74. The filter is mounted so that the filter screen 98 and end cap 96 extend downward within the body 78 of the calibration member 74. The design allows sufficient clearance around the outside diameter of the filter to allow the free flow of fuel into the upper end 86 of the calibration member and through the filter screen 98 and the interior of the body 78, passing out through the lower end 80 of the calibration member 74.

As shown in FIG. 1, the calibration assembly 58 is inserted into the fuel tube 12 with the enlarged portion 88 at its upper end forced into the inlet end of the fuel tube 12. The parts are sized for an interference fit forming a sufficient restriction to prevent any significant bypassing of fuel around the fuel filter within the calibration tube. The interference fit is also adequate to prevent the passage of particles around the filter which are greater than 30 microns which the filter is designed to remove from the fuel passing therethrough. The lower end 80 of the calibration member 74 is positioned with its annular seat 82 against the biasing spring 56 and with the spring guide 84 extending inside the upper end of the spring.

In order to calibrate the biasing spring to obtain the proper spring force against the injection valve 50, a calibrating tool 102 is used as shown in phantom in FIG. 1. During assembly of the injector, before insertion into the fuel rail cup 34, the tool 102 is inserted through the inlet end of the fuel tube 12 into engagement with the crimped over portion 100 of the calibration assembly 58 and a force, which can be as much as 40 to 80 pounds, is exerted which is adequate to slide the calibration tube downward against the spring until the desired spring force or fuel flow for the injector is reached. The calibrating tool 102 is then removed and the calibration assembly 58 is retained in fixed position within the injector by the substantial interference fit between the enlarged portion 88 of the calibration member 74 and the interior of the fuel tube 12. If desired, the body 78 of the calibration member could also be fitted with sufficient force into the tubular magnetic pole 46 to supplement the securing force applied to the calibration member within the fuel tube 12.

The improved assembly 58 of the calibration member 74 and fuel filter 76 and its interference mounting within the fuel tube 12 provides significant advantages in simplification and cost during the assembly of the fuel injector 10. Because the calibration assembly 58 is designed to allow calibration of the valve spring force with the filter in place, the fuel filter may be installed in the injector in an earlier stage of assembly of the injector than in injectors wherein the fuel filter is mounted separately at the inlet of the fuel tube. This allows the fuel filter to prevent contamination of the interior of the calibration tube and the valve member ball end 52 and armature within the fuel passage during assembly steps of the injector after insertion of the calibration assembly and during the calibration process itself.

In addition, the interference fit of the calibration assembly 58 within the fuel tube 12 prevents substantial bypassing of fuel around the fuel filter and positively precludes particles larger than that removed by the fuel filter from entering the fuel stream below the fuel filter within the injector tube. The interference fit also is sufficient to hold the calibration member 74 in position after calibration without requiring an additional step, such as crimping or welding, to hold the tube in place after the calibration process is completed. These advantages simplify the process of assembly and provide a significant reduction of cost in the assembly process.

Figure 3:
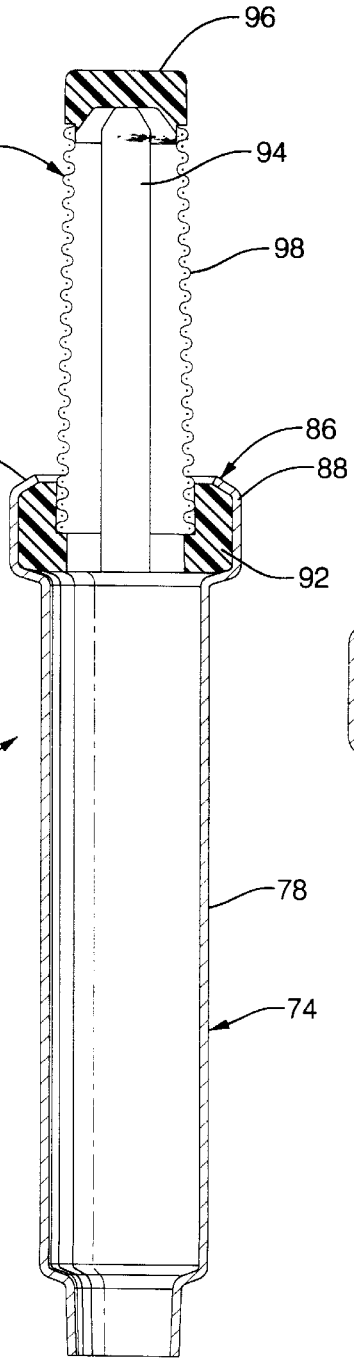
FIG. 3, is a cross-sectional view of an alternative embodiment of calibration tube with an internally mounted fuel filter wherein the body of the filter extends out through the inlet end of the calibration tube.
Figure 4:
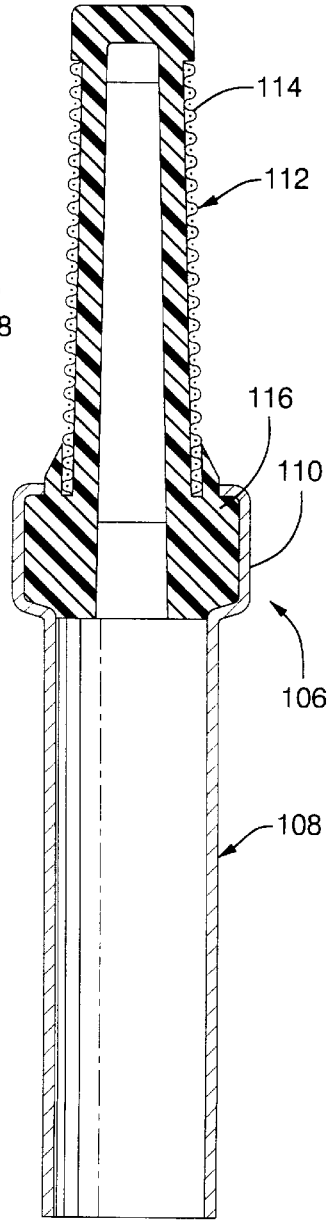
FIG. 4 is still another embodiment of calibration tube with an internally mounted fuel filter, wherein the filter body is insert molded within the tube and the body also extends out through the inlet end of the calibration tube.
Figure 5:
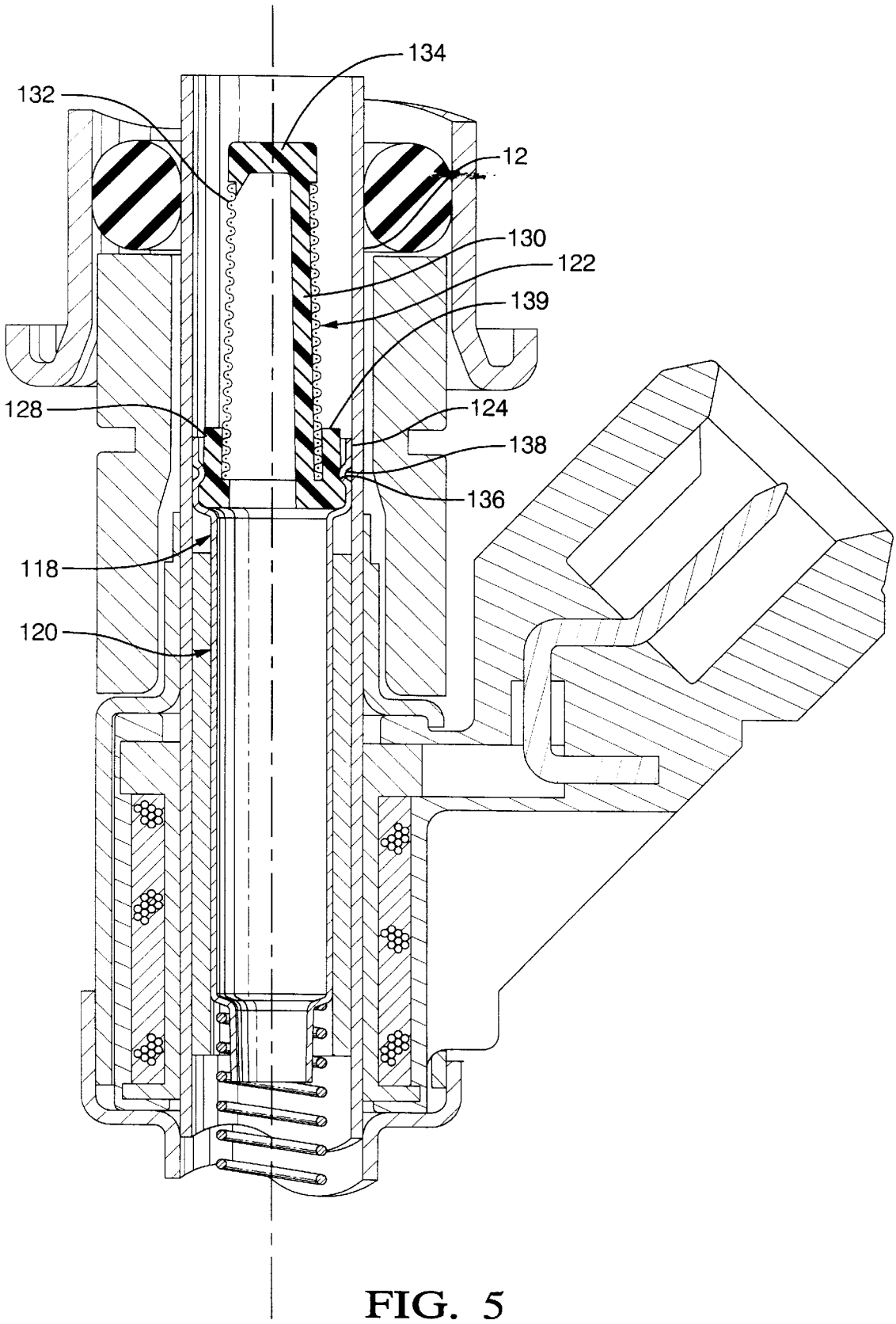
FIG. 5 is a cross-sectional view of yet another embodiment of calibration tube with an internally mounted filter, wherein the filter body has a base that is snap fitted into the inlet of the tube and the body extends outward from the inlet end of the tube which is shown as mounted within an injector assembly.

FIGS. 3–5 illustrate some alternative embodiments of calibration assemblies which are exemplary of various additional forms that may be utilized within the scope of the invention. In FIG. 3, calibration assembly 104 includes a calibration member 74 and a fuel filter 76, as in FIG. 2. However, the fuel filter is reversed in position so that, while its hollow base 92 is still crimped into the enlarged portion 88 of the calibration member body 78, the filter screen 98 and the supporting ribs 94 and cap 96 extend out through the inlet end or upper end 86 of the calibration member so that fuel flow passes through the filter screen in the opposite direction from the embodiment of FIG. 2.

In spite of the protruding fuel filter, calibration of the force on the biasing spring 56 within the injector may be accomplished in the same manner by a tubular calibration tool, not shown, which extends into engagement with the crimped over portions 100 at the upper end of the calibration member body 78. In this way, sufficient force can be applied to the calibration assembly 104 as to the previous assembly embodiment 58 to permit the assembly 104 to be retained in the fuel tube by an interference fit. The required force, which may be in the neighborhood of 40–80 pounds would be excessive if it was intended to calibrate the assembly by applying force to the plastic filter cap, or the filter frame would have to be made much stronger at additional cost in order to accept forces of this magnitude.

Referring now to FIG. 4, an alternative embodiment of calibration assembly 106 is illustrated. The calibration member 108 is formed with a straight cylindrical lower end but could optionally be formed with the stepped in smaller diameter of the previously described embodiments, if desired. The upper end includes an enlarged portion 110 into which a filter 112 is insert molded. In this process, the calibration member 108 and filter screen 114 are positioned in their proper relationship within plastic molding dies and the plastic frame 116 is molded in place. The frame 116 includes an integral base, spaced ribs and cap, all of which secure the filter screen 114 in place and the insert molding process fixes the frame 116 within the enlarged portion 110 of the calibration member 108. The resulting assembly 106 is installed in the injector fuel tube 12 and calibrated in the same manner as with the previously described embodiments.

Referring now to FIG. 5, a calibration assembly 118 is illustrated having a calibration member 120 and a fuel filter 122. Member 120 is formed at its lower end with the same configuration as in the embodiments of FIGS. 2 and 3, whereas the upper end 124 is enlarged with a generally cylindrical end portion having an internally raised bead 138 intermediate the ends of the enlarged portion. The accompanying fuel filter 122 includes an outwardly extending annular plastic base 128 connecting at its lower end with wraparound ribs 130 that extend around the lower end of a filter screen 132 and longitudinally upward to a closed outer end cap 134 while providing intermediate support to the filter screen between its ends. The base 128 includes an intermediate annular recess 136 which allows the filter assembly to be snapped into engagement with the upper end 124 of the calibration member 120. There it is held in place by the inwardly raised bead 138 engaging the annular recess 136 of the filter base 128.

Installation of the assembly 118 into the fuel tube 12 of an associated injector can be accomplished in the same manner as before except that the tubular calibration tool, not shown, is positioned to engage the upper edge 139 of the plastic fuel filter base 128 rather than crimped over metal portions of the calibration member as in the previous embodiments. While calibration member 118 is shown with the fuel filter 122 extending outward from its mounting within the calibration member or tube 120, as is the case with the embodiments of FIGS. 3 and 4, it should be recognized that the embodiment of FIG. 5 could be designed for installation in the reverse direction with the filter extending into the lower body portion of the calibration member, as in the embodiment of FIG. 2. The base 128 of the filter frame would still, if properly designed, snap into the enlarged upper end 124 of the calibration member. The filter would then operate in the same manner as described for the embodiment of FIG. 2 except, again, the calibration tool would engage the outer end of the base 128 instead of the calibration member itself. In both instances, however, the inwardly extending filter member has the advantage, if needed, that the injector may be made shorter, where the associated engine application would permit, than would be the case with outwardly extending filter mounting arrangements, such as in FIGS. 3 and 4.

The various embodiments of calibration members described herein have been shown with a fuel injector having a continuous fuel tube defining the fuel passing through the injector. However, the invention is also applicable to other forms of top feed fuel injectors which include a fuel inlet tube through which a calibration tube assembly may be inserted.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A fuel injector having inlet and discharge ends and comprising:

a fuel tube at the inlet end through which fuel is admitted to a fuel passage extending to the discharge end;

a valve at the discharge end and having a valve element reciprocable against and away from a valve seat to prevent or allow fuel discharge through the valve seat;

a biasing spring having a first end operatively engaging the valve element;

a calibration member having first and second ends and defining a portion of the fuel passage through which fuel must pass to the injector discharge end, the calibration member having adjacent the first end an enlarged portion engaging the fuel tube with an interference fit, the second end defining a spring seat operatively engaging the spring and biasing the spring against the valve element with a set force for controlling fuel discharge from the injector, the calibration member being adjustable within the injector for calibrating the spring to establish the set force; and a fuel filter mounted within the calibration member and effective to filter all the fuel passing through the calibration member defin portion of the fuel passage, said filter having an enlarged hollow base received within the enlarged portion of the calibration member and mounting the filter in the calibration member.

2. A fuel injector as in claim 1 wherein the calibration member is adjustable by sliding within the injector and the interference fit of the enlarged portion with the fuel inlet tube is adequate to maintain a set position of the calibration member after calibration adjustment and prevent a substantial bypass of fuel around the filter.

3. A fuel injector as in claim 2 wherein the calibration member is a metal tube.

4. A fuel injector as in claim 3 wherein said enlarged portion of the tube is engagable by a tool for slidably adjusting the calibration member with a force adequate to overcome resistance of the interference fit.

5. A fuel injector as in claim 3 wherein the filter has a plastic frame including the enlarged hollow base connected by a plurality of annularly spaced ribs with a closed end and a tubular filter screen between the base and the closed end and supported by the ribs for filtering out particles above about 30 microns.

6. A fuel injector as in claim 3 wherein the calibration member second end is stepped to a smaller diameter to form the spring seat and an internally adjacent spring guide.

7. A fuel injector as in claim 5 wherein the filter screen extends within the metal tube toward the spring seat.

8. A fuel injector as in claim 5 wherein the filter screen extends out through the first end of the calibration member into the inlet end of the fuel tube.

9. A fuel injector as in claim 8 wherein the filter frame base is insert molded into the enlarged portion of the tube while the filter screen is molded into the frame.

10. A fuel injector as in claim 5 wherein the filter frame base is secured within the enlarged portion of the tube by snap fitting.

11. A fuel injector as in claim 1 wherein said calibration member and said fuel filter comprise a calibration assembly formed prior to installation in the fuel injector fuel inlet tube.

12. A calibration assembly for insertion in a fuel tube of a fuel injector for setting a valve spring seating force in the injector, said assembly comprising:

a calibration member having first and second ends and capable of defining a portion of a fuel passage, the calibration member having adjacent the first end an enlarged portion engagable with the fuel tube with an interference fit, the second end defining a spring seat operatively engagable with the spring to establish a set force; and a fuel filter mounted within calibration member for filtering all the fuel passing through the calibration member, said filter having an enlarged hollow base received within the enlarged portion of the calibration member for mounting the filter in the calibration member.

13. A calibration assembly as in claim 12 wherein the calibration member is a metal tube.

14. A calibration assembly as in claim 12 wherein said enlarged portion of the calibration member is engagable by a tool for slidably adjusting the calibration member with a force adequate to overcome resistance of the interference fit.

15. A calibration assembly as in claim 12 wherein the filter has a plastic frame including the enlarged hollow base connected by a plurality of annularly spaced ribs with a closed end and a tubular filter screen between the base and the closed end and supported by the ribs for filtering out particles above about 30 microns.

16. A calibration assembly as in claim 12 wherein the calibration member second end is stepped to a smaller diameter to form the spring seat and an internally adjacent spring guide.

17. A calibration assembly as in claim 16 wherein the filter screen extends within the metal tube toward the spring seat.

18. A calibration assembly as in claim 16 wherein the filter screen extends out beyond the first end of the calibration member.

19. A calibration assembly as in claim 18 wherein the filter frame base is insert molded into the enlarged portion of the tube while the filter screen is molded into frame.

20. A calibration assembly as in claim 15 wherein the filter frame base is secured within the enlarged portion of the tube by snap fitting.

* * * * *